United States Patent [19]

Russell

[11] 4,319,444

[45] Mar. 16, 1982

[54] ENVELOPE PROCESSING MACHINE WITH INCREMENTAL FEED MECHANISM

[75] Inventor: Robert J. Russell, Medford, N.J.

[73] Assignee: Mail-Ex Corporation, Skokie, Ill.

[21] Appl. No.: 78,919

[22] Filed: Sep. 26, 1979

[51] Int. Cl.[3] ..... B65B 5/00; B65B 43/30

[52] U.S. Cl. ..... 53/569; 53/266 A; 53/381 R; 53/386

[58] Field of Search ..... 53/381 R, 266 A, 569, 53/386; 83/912

[56] References Cited

U.S. PATENT DOCUMENTS

| | | | |
|---|---|---|---|
| 2,325,455 | 7/1943 | Williams | 53/381 R X |
| 2,806,335 | 9/1957 | McWhirter . | |
| 3,143,100 | 8/1964 | Krupotich | 53/381 R |
| 3,382,126 | 5/1968 | Hackmann | 53/266 A X |
| 3,384,252 | 5/1968 | West . | |
| 3,691,726 | 9/1972 | Stephens et al. . | |
| 3,884,010 | 5/1975 | Bardo et al. . | |
| 3,979,884 | 9/1976 | Russell | 53/386 X |
| 4,110,958 | 9/1978 | Stevens | 53/386 |
| 4,159,611 | 7/1979 | Russell | 53/386 X |

*Primary Examiner*—Horace M. Culver

*Attorney, Agent, or Firm*—Trexler, Bushnell & Wolters, Ltd.

[57] ABSTRACT

There is disclosed a new and improved envelope processing machine. The machine includes an envelope hopper for storing a quantity of envelopes to be processed, an envelope processing station, spaced from the hopper, a table top surface adjacent the processing station providing a work surface for an operator, and incrementing conveyor means extending beside the table top surface and from the hopper past the processing station. The conveyor means is arranged for incrementally conveying the envelopes a predetermined distance in immediate succession from the hopper to the processing station through at least one intermediate stop position between the hopper and the processing station. As a result, sufficient spacing between the hopper and the processing station is provided to permit the table top surface to be dimensioned for providing a sufficient work surface area for an operator while still maintaining an efficient processing rate.

7 Claims, 3 Drawing Figures

ENVELOPE PROCESSING MACHINE WITH INCREMENTAL FEED MECHANISM

BACKGROUND OF THE INVENTION

The present invention is generally directed to an improved envelope processing machine, and more particularly, to an envelope processing machine having an incrementing conveyor for conveying the envelopes to the machine processing station through one or more intermediate stop positions.

Envelope processing machines are known in the prior art wherein the contents within envelopes are mechanically extracted from the envelopes. One such machine is described, for example, in West, U.S. Pat. No. 3,384,252. In such machines, envelopes are removed from a supply hopper, transmitted to a cutting station where one edge of the envelope is cut open, and then transmitted to a removal station whereat the envelope is opened and the contents mechanically extracted. The present invention provides for the manual removal or insertion of the contents of an envelope at the processing station, thus avoiding the complexity and the problems incident to the operation of mechanical processing means.

Envelope processing machines are also known in the prior art wherein envelopes are removed from a supply hopper, severed along one edge at a cutting station, and transmitted to a station whereat the envelope is opened and held open for manual removal of the contents therefrom. Such a machine is fully described and claimed in U.S. Pat. No. 4,159,611 which is assigned to the assignee of the present invention.

Semi-automatic envelope processing machines of this kind require that the supply hopper, which contains a quantity of envelopes to be processed, be displaced from the processing station by a considerable distance. The reasons for this are twofold. First, and most importantly, a table top surface adjacent to the processing station is required to provide an operator with a work surface. This table top surface must be sufficiently large so as to provide a work surface or area which does not confine the operator to minimize the fatigue which would naturally result from repetitious and tedious work. Secondly, many such machines employ the aforementioned cutter station which severs one edge of the envelope. The cutter station must be disposed between the hopper and the processing station. Sufficient spacing on both sides of the cutter from the processing station and the hopper is necessary to prevent jamming of the machine. Hence, the spacing between the hopper and the processing station must be many times the length of an envelope.

Prior machines included a conveyor which conveyed the envelopes along a continuous or uninterrupted path from the hopper to the processing station. Because this path was relatively long, a considerable amount of envelope processing time was lost during the conveyance of the envelopes from the hopper to the processing station.

It is therefore a general object of the present invention to provide a new and improved envelope processing machine.

It is a further object of the present invention to provide an envelope processing machine which includes an incrementing conveyor means arrange to incrementally convey the envelopes a predetermined distance in immediate succession from the hopper to the processing station to at least one intermediate stop position between the hopper and the processing station to thereby allow sufficient spacing between the hopper and the processing station to permit the table top surface to be dimensioned for providing a sufficient work surface area for an operator while still maintaining an efficient envelope processing rate.

The invention therefore provides an envelope processing machine comprising an envelope hopper for storing a quantity of envelopes to be processed, and envelope processing station spaced from the hopper, a table top surface adjacent to the processing station providing a work surface for an operator, and incrementing conveyor means extending beside the table top surface for conveying the envelopes from the hopper to the processing station. The conveyor means is arranged for incrementally conveying the envelopes a predetermined distance in immediate succession to at least one intermediate stop position between the hopper and the processing station to thereby allow sufficient spacing between the hopper and the processing station to permit the table top surface to be dimensioned for providing a sufficient work surface area for an operator while still maintaining an efficient envelope processing rate.

BRIEF DESCRIPTION OF THE DRAWINGS

The features of the present invention which are believed to be novel are set forth with particularity in the appended claims. The invention, together with further objects and advantages thereof may best be understood by making reference to the following description taken in conjunction with the accompanying drawings, where in the several figures like reference numerals identify identical elements and wherein:

DESCRIPTION OF THE PREFERRED EMBODIMENT

Figure 1:
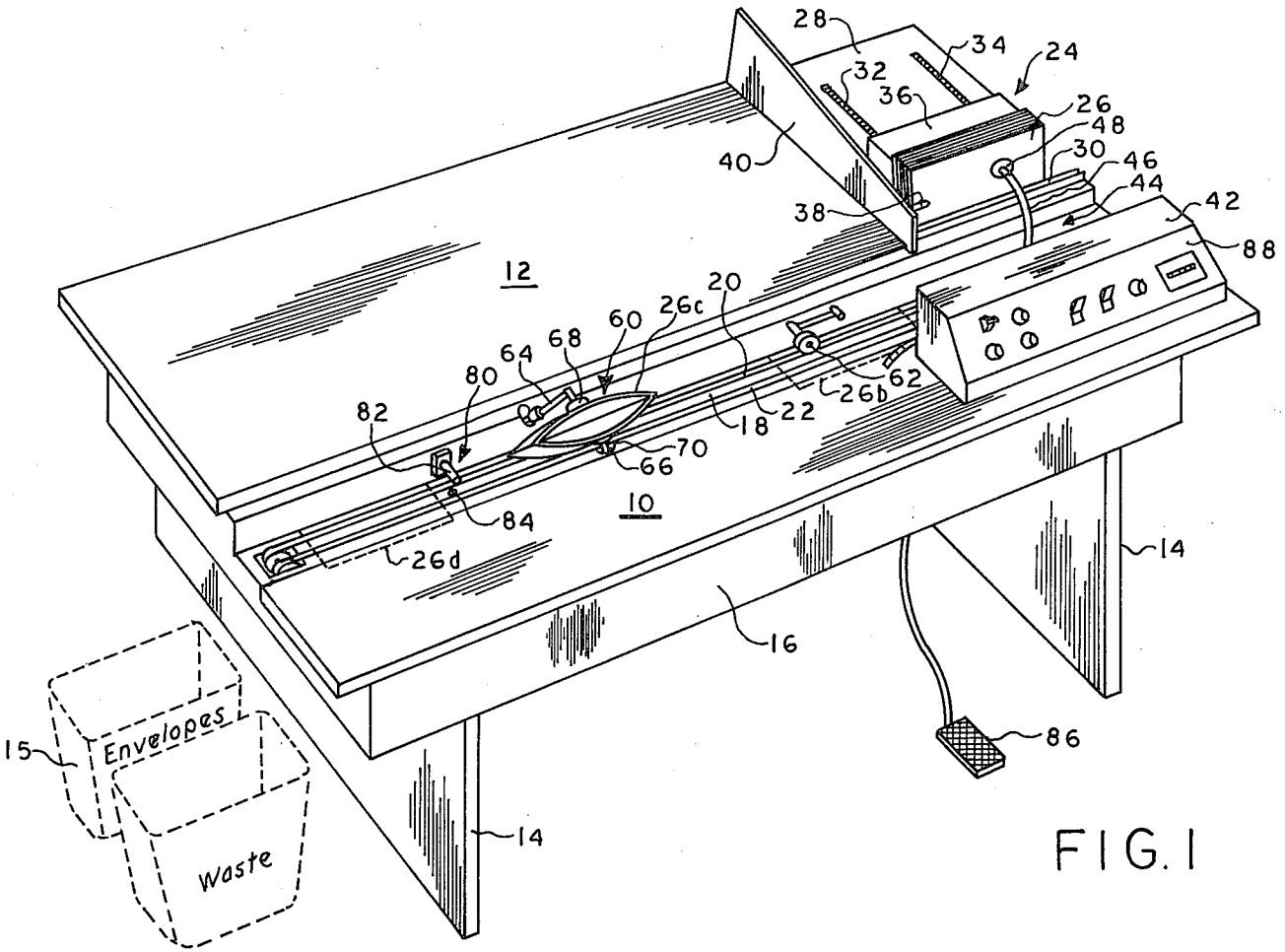
FIG. 1 is a general prospective view of an envelope processing machine embodying the present invention.

Referring now to FIG. 1, the envelope processing machine there shown constructed in accordance with the present invention generally includes lower and upper offset table structures 10 and 12 supported at table height by legs 14. The upper table 12, covers the internal mechanism of the machine and conveniently provides a work and table surface. The operator sits facing the lower table surface 10 at the front panel of the machine indicated by the reference numeral 16. The lower table surface 10, extends generally across the entire width of the machine and provides an unconfined work surface area for an operator. Between the upper table 12 and lower table surface 10, there is disposed a substantially horizontal plate 18. The plate 18, supports a pair of endless conveyor belts 20 and 22, which form a portion of an incrementing conveyor means to be described in greater detail hereinafter. The conveyor belts 20 and 22 convey the envelopes to be processed from one station of the machine to the next in immediate succession.

To the right of the upper table surface 12, there is provided a supply hopper 24, arranged to contain a plurality of envelopes 26 to be processed. The hopper 24 includes an inclined surface 28, a pair of endless belts 32 and 34 arranged to travel along the surface 28, a weight block 36, and a retainer 38, which projects in the direction of the envelopes 26 from a side abutment plate 40. The envelopes 26 are arranged in stacked relation and held in that position against the abutment plate 40 by the co-action of the retainer 38, a lip portion 30 extending from the surface 28, and the weight block 36. Between the hopper 24 and the control box 42 of the machine, there is provided a feed means or station 44 which includes a reciprocating arm 46 which terminates in a suction cup 48. The reciprocating arm 46 is connected to a source of negative air pressure (not shown) and transmits the air suction to the suction cup 48 to facilitate gripping of the envelope 26 by the suction cup 48. The arm 46, is arranged to pivot from a retracted position whereat the suction cup 48, is beneath the plate 18 to the illustrated position in FIG. 1 for gripping the envelopes 26, one at a time, and placing the envelopes onto the conveyor belts 20 and 22. A mechanism for causing the arm 46 to reciprocate as described is fully shown and described in the aforementioned U.S. Pat. No. 4,159,611. As the arm 46 pivots to its retracted position, the envelope gripped by the suction cup 48 is pulled free of the retainer 38 and lip 30 and downwardly to the conveyor.

As the feed means 44 operates, the belts 32 and 34 travels along the inclined surface 28 and the weight 36 decends along the inclined surface 28 to provide a continuous supply of stacked envelopes 26 for the feed means 44.

After being placed onto the conveyor, the envelopes are conveyed to a cutting station, 50 (FIGS. 2 and 3) including a rotary cutting blade 52 which severs one edge of the envelopes. As the envelopes are transferred to the cutting blade 52, they are orientated with respect to the cutter by a further conveyor belt 23 which is angularly disposed with respect to abutment member 54. The feed belt 23 causes the edge of the envelopes to be severed to engage the abutment member 54 to thereby properly orientate the envelopes with respect to the cutting blade 52. Additional angularly disposed belts may also be provided in a manner fully described in the aforementioned U.S. Pat. No. 4,159,611 to further promote the alignment of the envelopes with the cutting blade 52.

After being severed by the envelope cutter, the envelopes are then conveyed by the belts 20 and 22 to the processing station 60 whereat the envelopes are opened and retained in an open position to afford ready extraction of the contents therefrom by an operator. In being so conveyed, the envelopes are caused to pass beneath a pressure roller 62 which assures firm engagement of the envelopes with the belts 20 and 22.

The envelope processing station 60 includes an envelope opening means comprising of a pair of reciprocating arms 64 and 66 which terminate in suction cups 68 and 70 respectively. As in the case of the reciprocating arm 46, the arms 64 and 66 are connected to a source of negative air pressure (not shown) and convey the negative air pressure to the suction cups 68 and 70 to allow the suction cups 68 and 70 to grip and separate opposite panels of the envelopes 26 for opening the envelopes. Again, a mechanism for causing the arms 64 and 66 to co-act for opening the envelopes is fully shown and described in the aforementioned U.S. Pat. No. 4,159,661.

After the envelope has been opened and its contents removed, the envelope is once again placed on the belts 20 and 22 and conveyed to a detecting station 80 which detects the presence or absence of contents within an envelope. The detection station 80 includes a detector or candling mechanism comprising a light source 82 and a photo cell 84. The light source 82 and photo cell 84 are spaced apart for receiving the envelopes therebetween. As an envelope passes between the light source 82 and photo cell 84, if the light reaching the photo cell 84 from the light source 82, drops below a predetermined intensity, as for an example when contents from an envelope have been overlooked or otherwise not removed, the machine will stop and will remain stopped for so long as this condition exists. For a more complete description of such a detecting mechanism for use in such a machine as that shown in FIG. 1, reference may be had to the aforementioned U.S. Pat. No. 4,159,611.

Lastly, it can be noted in FIG. 1 that a foot switch 86 is provided. The foot switch 86 allows an operator to conveniently actuate the machine while in a sitting position and with the operators hands unoccupied. The control panel 88, as fully described in the aforementioned referenced patent, may be utilized for establishing the machine in a automatic sequence whereby one press of the foot pedal 86 causes the machine to run and continuously present opened envelopes to the operator, one at a time in succession, for the removal of contents therefrom. Furthermore, the control panel 88 may be utilized to establish an operator controlled sequence of the machine so that each envelope may be incremented along to the processing station upon each depression of the foot pedal 86.

As can be further noted from FIG. 1, the supply hopper 24 is laterally spaced from the processing station 60 by a considerable distance which is many times the length of one of the envelopes 26. As has been previously mentioned, the considerable spacing between the hopper 24 and processing station 60 is required to allow the lower table top surface 10 to be suitably dimensioned to provide an unconfined work area for the operator and to allow sufficient spacing between the cutting station 50 from the hopper 24 and processing station 60 to preclude jamming of the machine during its operation. Also, as has been previously mentioned, the conveyors of prior semi-automatic envelope processing machines of this kind have been arranged to convey the envelopes from the hopper 24 and feed station 44 to the processing station 60 in a continuous and uninterrupted manner. Because the hopper 24 and processing station 60 are spaced apart by considerable distance, valuable envelope processing time has been lost during the conveyance of the envelopes from the hopper 24 and feed station 44 to the processing station 60.

In order to overcome this deficiency of such prior machines, the envelope processing machine of the present invention includes a new and improved incrementing conveyor means which incrementally conveys the envelopes a predetermined distance in immediate succession to at least one intermediate stop position between the hopper 24 and processing station 60 as the envelopes are conveyed from the hopper 24 to the processing station 60. As will become apparent, the predetermined distance is less than twice the length of the envelopes. As a result, substantially less envelope processing time is lost as the envelopes are presented to the processing station 60 as compared to prior machines because the distance of travel of each of the envelopes between envelope processing, as a result of the present invention, is substantially less than the distance traveled by the envelopes in prior machines.

Figure 2:
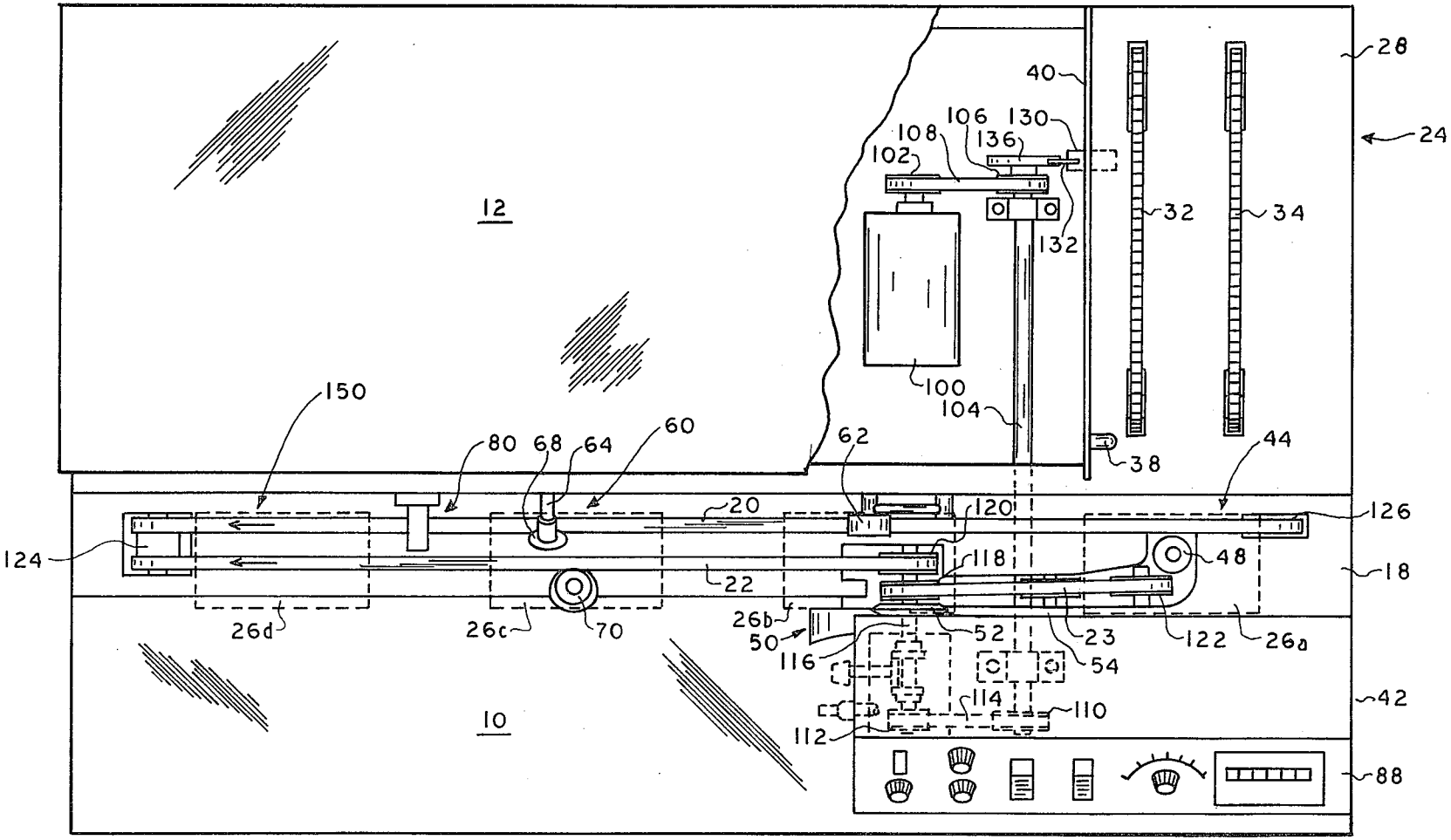
FIG. 2 is a top plan view of the machine of FIG. 1 with portions cut away illustrating the incrementing conveyor of the present invention.
Figure 3:
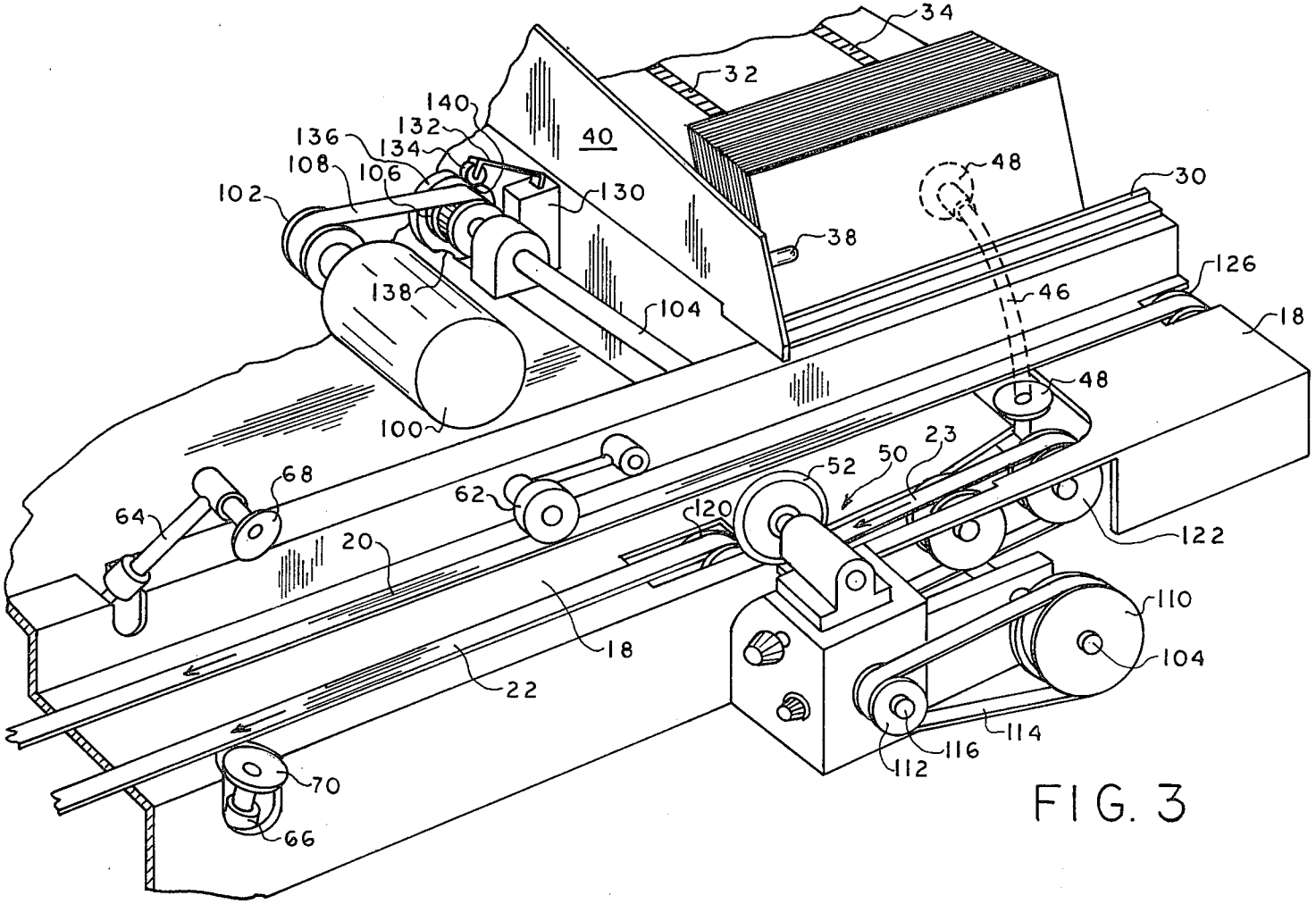
FIG. 3 is a partial perspective view of the machine illustrating further details of the incrementing conveyor embodying the present invention.

Referring now to FIGS. 2 and 3, the incrementing conveyor means includes a drive motor 100 having a pulley 102. The drive motor 100 drives a driven shaft 104 which includes another pulley 106 which is coupled to the motor 100 by a belt 108 extending from the pulley 102 to the pulley 106. The driven shaft 104 extends toward the front of the machine and terminates in a second shaft pulley 110. Pulley 110 is coupled to a pulley 112 by a belt 114. The pulley 112 is coupled to a shaft 116 which includes an additional pair of pulleys 118 and 120. The pulley 118 is coupled to an idler pulley 122 with the angularly disposed feed belt 23 extending across the pulleys 118 and 122.

The pulley 120 drives the conveyor belts 20 and 22 in the following manner. The conveyor belt 22 is carried by the pulley 120 and a double pulley 124 which also carries the conveyor belt 20. The conveyor belt 20 is further carried by another idler pulley 126. As a result of the foregoing arrangement, when the pulley 102 is rotated by the motor 100, the driven shaft 104 is caused to rotate which in turn drives the feed belt 23 and the conveyor belts 20 and 22. The pulleys are dimensioned such that upon one half rotation of shaft 104, that is to say a rotation through an angular distance of 180°, the belts 20, 22, and 23 are caused to travel a predetermined distance which is less than twice the length of one of the envelopes 26, but greater than the length of one of the envelopes 26. In order for the machine to accommodate envelopes of varying sizes, the pulleys may be arranged to cause the conveyor belts to travel a distance of, for example, eleven inches upon each half rotation of the driven shaft 104.

To control the motor 100, a micro switch 130 having a switch arm 132 is provided. The switch arm terminates in a roller 134 which rides upon the periphery of a cam 136. The cam 136 is provided with a pair of diametrically opposed notches 138 and 140. The switch 130 is arranged such that when the roller 134 of the arm 132 engages one of the notches 138 or 140, the switch 130 will open to de-energize the motor 100 and stop the travel of the belts 20, 22, and 23.

The foot switch 86 (FIG. 1) is connected in parallel with the switch 130 so that upon the depression of the foot pedal 86, the motor 100 will be energized to cause the driven shaft 104 to rotate and thus to cause the notches 138 and 140 to be disengaged from the roller 134. Upon disengagement of the roller from the notches, the switch 130 will be closed to provide power to the motor 100. After the driven shaft 104 has rotated one half revolution, the roller 134 will once again engage one of the notches 130 and 140 of cam 136 to de-energize the motor 100. Hence, upon each depression of the foot switch 86, the incrementing conveyor will be actuated to cause the belts 20, 22, and 23 to travel the aforementioned predetermined distance.

The operation of the incrementing conveyor of the machine and the various stations of the machine will now be described. Reference is directed to FIG. 2 where it can be noted that at anyone time, four envelopes are handled by the machine. The four envelopes are indicated by reference characters **26*a*, 26*b*, 26*c*, and 26*d*. The envelopes 26*a* through 26*d* are shown in their respective positions along a conveyor when the conveyor belts 20, 22, and 23** are at rest.

Envelope **26*a* is resting upon the conveyor at the feed station 44. Envelope 26*b* is at rest on the conveyor at an intermediate stop position between the hopper 24 and the envelope processing station 60. As can be noted from the figure, the envelope 26*b* is partially underneath the rotary cutting blade 52. Envelope 26*c* is at the envelope processing station and as may be noted in FIG. 1, is disposed in an open condition by the suction cups 68 and 70 to permit extraction of its contents by the operator. Lastly, envelope 26*d* is resting upon the conveyor at auxiliary station 150**.

Upon the next actuation of the foot switch 86, energizing power will be applied by the motor 100 to drive the driven shaft 104. As the driven shaft 104 turns, the belts 20, 22, and 23 will be caused to travel toward the left as viewed in FIG. 2. The shaft 104 will be rotated by the motor 100 until the switch arm 132 of the micro switch 130 engages the next notch 138 (FIG. 3) of cam 136. When the roller 134 of the switch arm 132 engages the notch 138, the driven shaft 104 will have been driven by the motor 100 through one half revolution and the conveyor belts 20, 22, and 23 will in turn have been caused to travel toward the left, a predetermined distance of, for example, eleven inches.

The envelopes **26*a*, 26*b*, and 26*c* will be caused to shift in position towards the left so that envelope 26*a* will stop at the intermediate stop position previously occupied by envelope 26*b*, envelope 26*b* will stop at the envelope processing station 60 previously occupied by envelope 26*c*, and envelope 26*c* will stop at the auxiliary station 150 previously occupied by envelope 26*d*. Envelope 26*d*, upon initiation of the new machine cycle will have been removed by the operator and deposited into an appropriate waste receptacle 15 (FIG. 1). At the moment the conveyor belts 20, 22 and 23 stop, the reciprocating arm 64 and 66 at the envelope processing station will move toward one another, grip the opposite panels of the envelope, and separate so as to open the envelope as shown in FIG. 1. Also responsive and subsequent to the halting of the conveyor belts 20, 22 and 23, the reciprocating arm 46 of the feed station 44 will pivot from its retracted position to its extended position as shown in FIG. 1 to grip the next envelope from the hopper 24 and to place that envelope onto the conveyor. When the new envelope is placed onto the conveyor in the position of the immediate preceding envelope, the machine will stop to afford the operator sufficient time to extract the contents from the envelope at the envelope processing station 60. Once the contents are extracted, the foot switch 86** may once again be depressed to initiate a new machine operational sequence.

While a foot switch 86 has been shown for actuating the incrementing conveyor and the other operational sequences of the machine, it must of course be understood that other means for doing so may be provided. For example, the initiation of each new machine sequence may be controlled automatically as disclosed in the aforementioned referenced patent, or may be initiated by other control means as for example, the control means described and claimed in U.S. Pat. No. 4,139,977 which is assigned to the assignee of the present invention. That control system operates responsive to movements of the hand of the operator in removing the contents of an envelope to control the operation of the machine.

Thus, it can be seen from the foregoing, that the present invention provides a new and improved envelope processing machine. More specifically, the present invention provides a new and improved semi-automatic envelope processing machine having an incrementing conveyor which is arranged to convey the envelopes a predetermined distance in immediate succession to an intermediate stop position immediately preceding the envelope processing station. Because upon each initiation of the machine operation, the conveyor belts travel a predetermined distance of, for example, eleven inches, or less than twice the length of an envelope, the envelopes are conveyed a relatively short distance from the intermediate stop position to the envelope processing station for extraction of their contents. As a result, the envelope processing station 60 may be laterally displaced from the envelope supply hopper 24 by a considerable distance as compared to the length of an envelope to allow sufficient space for the table top work surface 12 of such dimension that the operator will have an unconfined work area while still maintaining an efficient envelope processing rate. The efficient envelope processing rate is obtained because the envelopes need not be conveyed in a continuous and uninterrupted manner from the hopper 24 to the envelope processing station 62 which would take twice the time to achieve the envelope conveyance to the envelope processing station than the conveyance time achieved by the conveyor system of the present invention. It must also be recognized that while the envelope processing rate is increased due to the provision of the intermediate stop position of the incrementing conveyor, the actual speed of the conveyor need not be increased to obtain the increased envelope processing rate.

While a particular embodiment of the present invention has been shown and described, modifications may be made, and it is therefore intended to cover in the appended claims all such changes and modifications which fall within the true spirit and scope of the invention.

The invention is claimed as follows:

1. An envelope processing machine adapted for manual insertion or removal of envelope contents comprising: an envelope hopper for storing a quantity of envelopes to be processed; an envelope processing station spaced from said hopper a distance sufficient to have an envelope located therebetween in advance of the processing station; a table top surface adjacent said processing station providing a work surface for an operator; incrementing belt conveyor means extending beside said table top surface for conveying the envelopes in relatively closely spaced relationship in contact therewith from said hopper to said processing station, said conveyor means being arranged for incrementally conveying the envelopes a predetermined distance in immediate and close succession to at least one intermediate stop position at the said envelope location between said hopper and said processing station to thereby allow sufficient spacing between said hopper and said processing station to permit said table top surface to be dimensioned therealong for providing a sufficient and elongate work surface area for an operator while still maintaining an efficient envelope processing rate; and means at said processing station and operable with the conveyor means stopped for engaging and opening an envelope at its initial position in contact with the stopped conveyor means to facilitate manual insertion or removal of envelope contents.

2. An envelope processing machine as defined in claim 1 wherein said conveyor means is arranged to convey the envelopes in closely spaced relation therealong and wherein said predetermined distance is less than twice the length of the envelopes.

3. An envelope processing machine as defined in claim 2 further comprising actuating means for actuating said conveyor means and envelope feed means responsive to said conveyor means for transferring the envelopes from said hopper to said conveyor means in one-by-one relationship subsequent to the conveyance of the envelopes by said conveyor means through said predetermined distance.

4. An envelope processing machine as defined in claim 1 wherein said conveyor means is arranged to traverse the space from the hopper to and beyond the processing station and to convey the envelopes in a substantially horizontal disposition relative to the table top surface disposed between the conveyor means and the operator position in front thereof.

5. An envelope processing machine as defined in claim 4 wherein said conveyor means comprises a pair of endless conveyor belts.

6. An envelope processing machine as defined in claim 5 further comprising pulley means for driving said belts, a driven shaft coupled to said pulley means, motor means coupled to said driven shaft for driving said shaft, and stop means coupled to said driven shaft for de-energizing said motor means when said belts have traveled said predetermined distance.

7. An envelope processing machine as defined in claim 6 wherein said stop means comprises a cam carried by said driven shaft, a switch coupled to said motor means and having a control arm engaging said cam to cause said switch to de-energize said motor means after said driven shaft is rotated through a predetermined angular distance corresponding to said belts traveling said predetermined distance.

* * * * *